US006735887B1

(12) United States Patent
Muzzammel

(10) Patent No.: US 6,735,887 B1
(45) Date of Patent: May 18, 2004

(54) MANUAL SNOW PLOUGH

(76) Inventor: Mohiuddin M. Muzzammel, 11323 Bright Pond La., Reston, VA (US) 20194

( * ) Notice: Subject to any disclaimer, the term of this patent is extended or adjusted under 35 U.S.C. 154(b) by 0 days.

(21) Appl. No.: 10/041,461

(22) Filed: Jan. 10, 2002

Related U.S. Application Data

(63) Continuation of application No. 09/315,153, filed on May 20, 1999, now abandoned.

(51) Int. Cl.[7] ..... E01H 5/02
(52) U.S. Cl. ..... 37/285
(58) Field of Search ..... 37/265, 284, 285, 37/264, 278, 273; 172/354, 358, 365; 294/54.4, 57

(56) References Cited

U.S. PATENT DOCUMENTS

| | | | | | |
|---|---|---|---|---|---|
| 328,633 | A | | 10/1885 | Angell | |
| 1,683,732 | A | | 9/1928 | Selin | |
| 2,470,217 | A | | 5/1949 | McLoughlin | |
| 2,508,612 | A | * | 5/1950 | Kimbler | 37/284 |
| 3,007,263 | A | * | 11/1961 | Lair | 37/265 |
| 3,107,446 | A | * | 10/1963 | Messinger | 37/285 |
| 3,475,838 | A | * | 11/1969 | Hagen et al. | 37/265 |
| 3,594,932 | A | * | 7/1971 | Eriksson | 37/265 |
| 4,179,828 | A | * | 12/1979 | Brunty | 37/265 |
| 4,910,893 | A | | 3/1990 | Asay | |
| 5,511,327 | A | * | 4/1996 | Jurkowski et al. | 37/285 |
| 5,669,163 | A | * | 9/1997 | Winter | 37/284 |

* cited by examiner

*Primary Examiner*—Robert E. Pezzuto
(74) *Attorney, Agent, or Firm*—Joseph H. McGlynn

(57) ABSTRACT

A snow plough which has a handle on one end and a large snow scoop on the other. The plough is supported on a frame which is mounted on a pair of large wheels placed well behind the snow scoop.

10 Claims, 1 Drawing Sheet

FIG. 1
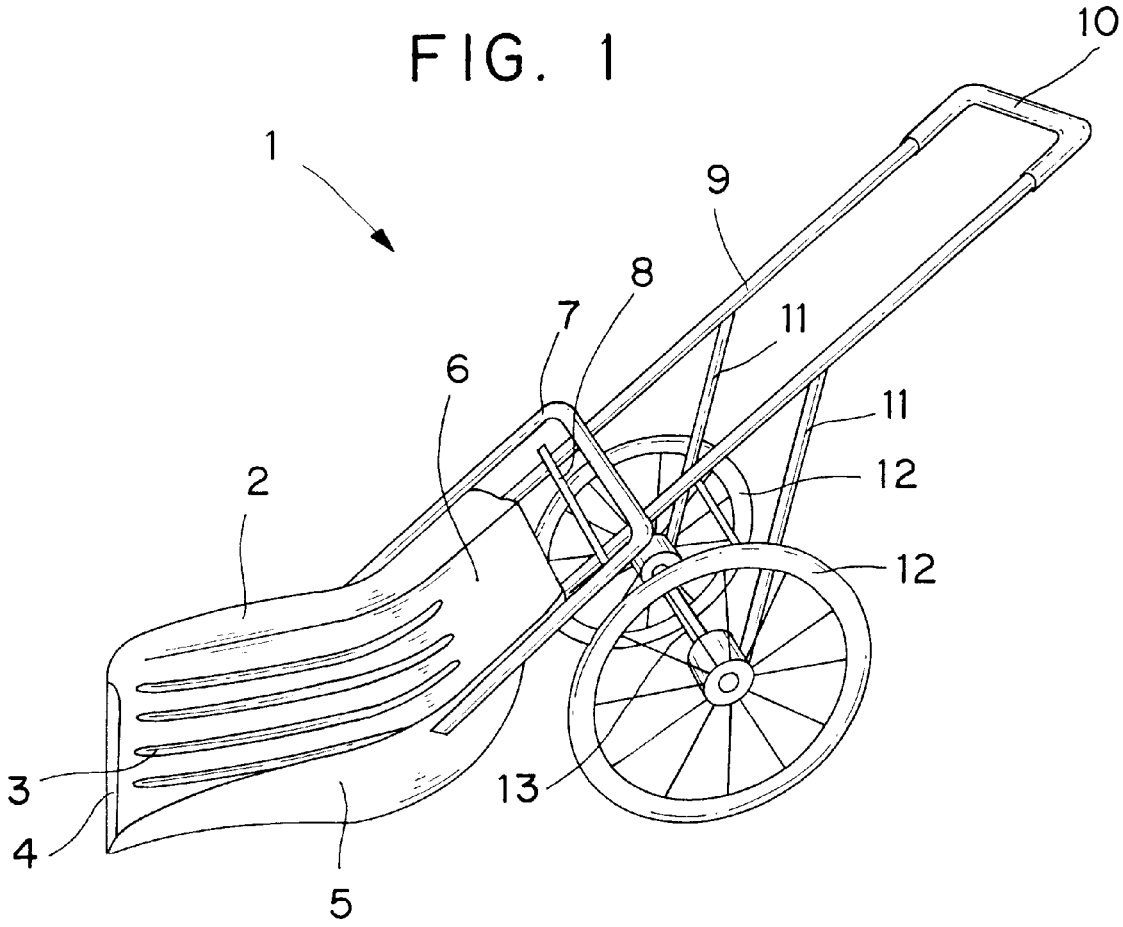
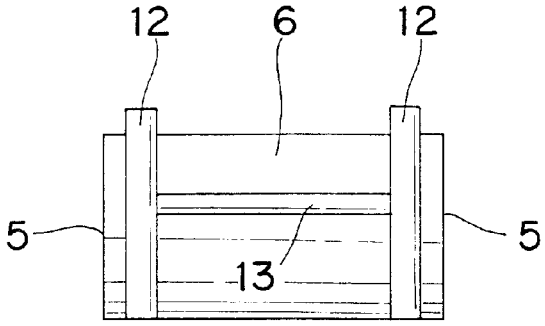
FIG. 2

MANUAL SNOW PLOUGH

This application is a Continuation of Ser. No. 09/315,153, filed May 20, 1999, now abandoned.

BACKGROUND OF THE INVENTION

This invention relates, in general, to snow shovels, and, in particular, to a snow shovel mounted on wheels.

Description of the Prior Art

In the prior art various types of snow shovels have been proposed. For example, U.S. Pat. No. 328,633 to Angell discloses a snow removing machine having a scoop at one end, a handle and wheels and a mechanism for lifting and lowering the scoop.

U.S. Pat. No. 1,683,732 to Selin discloses a snow shovel having a scoop at one end, a handle and wheels and the wheels are spaced apart less than the width of the scoop.

U.S. Pat. No. 2,470,217 to McLoughlin discloses a snow shovel having a scoop at one end, a handle and wheels and the wheels are spaced apart less than the width of the scoop.

U.S. Pat. No. 4,910,893 to Asay discloses a manually operated snow plough having a scoop at one end, a handle and wheels and the wheels are spaced apart less than the width of the scoop and a mechanism for adjusting the angle of the scoop.

SUMMARY OF THE INVENTION

The present invention is directed to a snow plough which has a handle on one end and a large snow scoop on the other. The plough is supported on a frame which is mounted on large wheels.

It is an object of the present invention to provide a new and improved manual operated snow plough.

It is an object of the present invention to provide a new and improved manual operated snow plough that is mounted on large wheels.

It is an object of the present invention to provide a new and improved manual operated snow plough that is inexpensive to produce and is equipped to handle large amounts of snow without straining the user.

These and other objects and advantages of the present invention will be fully apparent from the following description, when taken in connection with the annexed drawings.

BRIEF DESCRIPTION OF THE DRAWINGS

FIG. 1 is perspective view of the present invention.

FIG. 2 is a back view of the present invention showing the relative positions of the wheels and the scoop portion of the plough.

DESCRIPTION OF THE PREFERRED EMBODIMENT

Referring now to the drawings in greater detail, FIG. 1 shows a perspective view of the snow plough 1 of the present invention. The present invention is designed to be used by a homeowner and will allow removal of large amounts of snow easier. In addition to lifting the snow, the removed snow can be carried significant distances without undue strain on a user's back. This aspect is very important in areas which receive a significant amount of snowfall each year. The present invention does not use any fuel, which makes it environmentally friendly, and, in addition, will eliminate or lessen the use of chemicals such as salt.

The present invention has a scoop 2 which has sides 5 and a back 6. The scoop can be made from metal, plastic or any other suitable material. The front of the scoop can have a sharpened blade 4 attached thereto, in any conventional manner, which could be made from a strong metal to allow the scoop to penetrate into hard, packed snow or ice.

The scoop 2 has ridges 3 attached or made unitary with the horizontal portion of the scoop and extend up the angled back 6. These ridges will help prevent snow from sticking to the inside of the scoop which would require the user to stop and manually remove the snow from the scoop. The scoop has a U-shaped frame 7 attached thereto, by any conventional means, and which will be used to fasten the scoop to the handle portion 9. Frame 7 and handle 9 may be combine to form a one unit (i.e. unitary) metal frame.

The handle portion 9 is essentially U-shaped and is preferably made from metal for strength. It is attached at one end to the frame 7 by any conventional means. The handle also has braces 8, 11 extending down to the wheel hubs to further strengthen the handle portion and enable it to move large amounts of snow without bending or breaking.

A pair of large wheels 12 are mounted by means of an axle 13, and are connected to the handle by means of the braces 8, 11. The wheels will allow the user to easily move the plough into the snow and also allow the user to move the snow to a distant location without undue effort. This is especially important in areas which receive a large amount of snow each year. The pair of large wheels may be attached to the lower end of the brace 8, 11, instead of the axle. The pair of wheels are preferably between 6 inches and 26 inches in diameter. The pair of large wheels are placed well behind the snow scoop for easy lifting of the snow filled scoop. Wheels placed in this position also facilitates easy movement of the snow filled scoop for far distances with minimum or no strain on the user.

In these areas it is critical that the removed snow not be piled up adjacent a walk or driveway, since addition large amounts of snow will fall during the winter and soon there will be no place to put the removed snow, unless it is moved to a location distant from the walk or driveway. The present invention makes that task easier for the user.

The handle 9 has a soft cushion 10 secured to the upper portion of the handle, by any conventional means, where the user will grasp the handle. This will make it easier for the user to grasp the handle during prolonged snow removals.

FIG. 2 shows a back view of the present invention with all portions removed, for clarity, except the wheels 12, the axle 13 and the back of the scoop 6. As can be clearly seen in FIG. 2, the wheels 12 are mounted so they do not extend beyond the sidewalls 5 of the scoop. If the wheels extended beyond the sidewalls 5 they might become bogged down in the snow that the scoop had not, as yet, removed. This would make snow removal difficult, and perhaps impossible.

In addition, the wheels extend slightly above the back 6 of the scoop. Since the portion of the scoop which will have the most snow on it will be the lower portion where the ridges 3 are, and since this portion of the scoop is beneath the axle 13, the load of snow will lower the center of gravity of the plough. This will make the plough, when loaded with snow, more stable and, therefore, easier to move.

Although the Manual Snow Plough and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A manual snow plough comprising:

a scoop means for receiving snow, said scoop means being attached to a frame portion, at least a pair of wheels attached to said scoop means, a handle attached to said wheels, said scoop having a front end, a back end and side walls, said side walls being spaced apart a first selected distance, said at least a pair of wheels being spaced apart a second selected distance, said first selected distance being larger than said second selected distance, and wherein said wheels extend above said back end of said scoop means.

2. The manual snow plough as claimed in claim 1, wherein said scoop means has a sharpen blade attached to said front end.

3. The manual snow plough as claimed in claim 1, wherein said scoop means have a plurality of ridges extending along an inside surface thereof.

4. The manual snow plough as claimed in claim 1, wherein said wheels are at least 6 inches in diameter.

5. The manual snow plough as claimed in claim 1, wherein said wheels are placed well behind said scoop means and are attached to said frame portion by braces.

6. A manual snow plough comprising:

a scoop means for receiving snow, said scoop means being attached to a frame portion, at least a pair of wheels attached to said scoop means, a handle attached to said wheels, said scoop having a floor comprising a front end, a back end and sides, said scoop also having side walls extending upwardly from said floor and a rear portion extending upwardly from said back end of said floor, said side walls having a bottom most end and a top most end, said side walls being spaced apart a first selected distance, said at least a pair of wheels being spaced apart a second selected distance, said first selected distance being larger than said second selected distance, and wherein said rear portion has a bottom most portion and a top most portion, and said wheels extend above said top most portion of said rear portion of said scoop means, and said wheels also extend above said top most end of said sidewalls.

7. The manual snow plough as claimed in claim 6, wherein said scoop means has a sharpen blade attached to said front end.

8. The manual snow plough as claimed in claim 6, wherein said scoop means have a plurality of ridges extending along an inside surface thereof.

9. The manual snow plough as claimed in claim 6, wherein said wheels are at least 6 inches in diameter.

10. The manual snow plough as claimed in claim 6, wherein said wheels are placed well behind said scoop means and are attached to said frame portion by braces.

* * * * *